US005987283A

United States Patent [19]

Zhao et al.

[11] Patent Number: 5,987,283

[45] Date of Patent: Nov. 16, 1999

[54] APPARATUS AND METHOD FOR DEVELOPING AN ELECTROSTATIC LATENT IMAGE DIRECTLY FROM AN IMAGING MEMBER TO A FINAL SUBSTRATE

[75] Inventors: Weizhong Zhao, Webster; Chu-heng Liu, Penfield, both of N.Y.

[73] Assignee: Xerox Corporation, Stamford, Conn.

[ * ] Notice: This patent is subject to a terminal disclaimer.

[21] Appl. No.: 09/232,651

[22] Filed: Jan. 19, 1999

[51] Int. Cl.[6] ..... G03G 15/10; G03G 15/16

[52] U.S. Cl. ..... 399/237; 399/296

[58] Field of Search ..... 399/237, 296, 399/148, 249

[56] References Cited

U.S. PATENT DOCUMENTS

| | | | |
|---|---|---|---|
| 4,267,556 | 5/1981 | Fotland et al. . | |
| 4,504,138 | 3/1985 | Kuehnle et al. . | |
| 4,885,220 | 12/1989 | Kuhman et al. . | |
| 5,387,760 | 2/1995 | Miyazawa et al. . | |
| 5,436,706 | 7/1995 | Landa et al. . | |
| 5,557,378 | 9/1996 | Abreu et al. | 399/249 X |
| 5,614,998 | 3/1997 | Sanpe | 399/296 X |
| 5,619,313 | 4/1997 | Domoto et al. . | |
| 5,826,147 | 10/1998 | Liu et al. | 399/237 |

*Primary Examiner*—Susan S. Y. Lee
*Attorney, Agent, or Firm*—Oliff & Berridge, PLC

[57] ABSTRACT

An apparatus and method develops an electrostatic latent image directly from an imaging member to a final substrate, such as paper or the like. An image development apparatus and method creates a first electrostatic latent image on an imaging member and deposits a toner layer on the imaging member. The image developer then generates a second electrostatic latent image in the toner layer in response to the first electrostatic latent image on the imaging member. The second electrostatic latent image can be generated by either a broad source ion charging device or an air breakdown charging device. Next, the latent image bearing toner layer is selectively separated and developed such that the image areas are developed directly from the imaging member onto a final substrate and the non-image areas remain on the imaging member.

26 Claims, 6 Drawing Sheets

APPARATUS AND METHOD FOR DEVELOPING AN ELECTROSTATIC LATENT IMAGE DIRECTLY FROM AN IMAGING MEMBER TO A FINAL SUBSTRATE

BACKGROUND OF THE INVENTION

1. Field of Invention

The present invention relates generally to electrostatic latent image development, and more particularly, to an apparatus and method for developing an electrostatic latent image directly from an imaging member to a final substrate, such as paper or the like.

2. Description of Related Art

In a typical electrostatographic printing process, copying and printing are initiated by selectively charging and/or discharging a charge receptive imaging member in accordance with an original input document or an imaging signal, thereby generating an electrostatic latent image on the imaging member. This latent image is subsequently developed into a visible image by a process in which charged developing material is deposited onto the surface of the latent image bearing imaging member. Charged particles in the developing material adhere to image areas of the latent image to form a visible developed image corresponding to the latent image on the imaging member. The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The developing material typically comprises carrier granules having toner particles adhering triboelectrically thereto, wherein the toner particles are electrostatically attracted from the carrier granules to the latent image areas to create a powder toner image on the imaging member. Alternatively, the developing material may comprise a liquid developing material comprising a carrier liquid having pigmented marking particles (or "toner solids") and charge director materials dispersed and/or dissolved therein, wherein the liquid developing material is applied to the latent image bearing imaging member with the marking particles being attracted to the image areas of the latent image to form a developed liquid image. Regardless of the type of developing material employed, the toner or marking particles of the developing material are uniformly charged and are electrostatically attracted to the latent image.

The above-described electrostatographic printing process is well known and has been implemented in various forms in the marketplace to facilitate, for example, light lens copying of an original document, as well as printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface (see, for example, U.S. Pat. Nos. 4,267,556 and 4,885,220, among numerous other patents and publications), as well as other electrostatic printing systems wherein a charge carrying medium is adapted to carry an electrostatic latent image. It will be understood that the instant invention applies to all various types of electrostatic printing systems and is not intended to be limited by the manner in which the image is formed on the imaging member or the nature of the latent image bearing member itself.

The typical electrostatographic printing process described above includes a development step whereby developing material is physically transported into contact with the imaging member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (referred to as charged area development (CAD), or "write white" systems), while other printing processes operate in a manner such that discharged areas attract developing material (referred to as discharged area development (DAD), or "write black" systems).

U.S. patent applications Ser. No. 08/883,292 (the application Ser. No. '292), filed Jun. 27, 1997, and Ser. No. 08/884,236, (the application Ser. No. '236) filed Jun. 27, 1997, each herein incorporated by reference in its entirety, disclose electrostatographic imaging processes where an electrostatic latent image bearing member having a layer of marking material coated thereon is selectively charged in an image-wise manner to create a secondary latent image corresponding to the electrostatic latent image on the imaging member.

In the incorporated application Ser. No. '292, the image-wise charging is accomplished by a wide beam charge source for introducing free mobile charges, or ions, in the vicinity of the electrostatic latent image coated with the layer of marking material or toner particles. The latent image causes the free mobile ions to flow in an image-wise ion stream corresponding to the latent image. These ions, in turn, are captured by the marking material or toner particles, leading to image-wise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

In the incorporated application Ser. No. '236, the image-wise charging is accomplished by inducing the ionization of air via a phenomenon known as air breakdown for introducing free mobile ions in the vicinity of the electrostatic latent image coated with the layer of toner particles. The formation of electrostatic charge patterns by electrical discharges involves the phenomena of ionic conduction through gases. It is known that when two conductors are held near each other with a voltage applied between the two, electrical discharge will occur as the voltage is increased to the point of air breakdown. This discharge is usually accompanied by a visible spark. However, when the conductors are very close together (a few thousands of an inch) discharge can take place without sparking and electrical charges will be collected on a receiving surface during discharges. As described above, the latent image causes the free mobile ions to flow in an image-wise ion stream corresponding to the latent image. The ions, in turn, are captured by the marking material in the layer, leading to image-wise charging of the marking layer with the marking material layer itself becoming the latent image carrier. The latent image carrying toner layer is subsequently developed by selectively separating image areas of the toner layer and transferring the separated image to a copy substrate for producing an output document.

U.S. Pat. No. 4,504,138 to Kuehnle et al. discloses a method of developing a latent electrostatic charge image formed on a photoconductor surface. The method includes (1) applying a thin viscous layer of electrically charged toner particles to an applicator roller, preferably by electrically assisted separation thereof from a liquid toner suspension, (2) defining a restricted passage between the applicator roller and the photoconductor surface which approximates the thickness of the viscous layer, and (3) transferring the toner particles from the applicator roller at the photoconductor surface due to the preferential adherence thereof to the photoconductor surface under the dominant influence of the electric field strength of the electrostatic latent image carried by the photoconductive surface. The quantity of toner particles that is transferred is proportional to the relative incremental field strength of the latent electrostatic image. An apparatus for carrying out the method includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 to Miyazawa et al. describes a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 to Landa et al. discloses an imaging apparatus including a first member having a first surface with a latent electrostatic image formed thereon, wherein the latent electrostatic image includes image regions at a first voltage and background regions at a second voltage. A second member charged to a third voltage between the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selectively transferring portions of the layer of liquid toner from the second surface to the first surface.

U.S. Pat. No. 5,619,313 to Domoto et al. describes a method and apparatus for simultaneously developing and transferring a liquid toner image. The method includes (1) moving a photoreceptor including a charge bearing surface having a first electrical potential, (2) applying a uniform layer of charge having a second electrical potential onto the charge bearing surface, and (3) dissipating charge, image-wise, from selected portions on the charge bearing surface to form a latent image electrostatically, such that the charge dissipated portions of the charge bearing surface have the first electrical potential of the charge bearing surface. The method also includes moving an intermediate transfer member biased to a third electrical potential that lies between said first and said second potentials, into a nip forming relationship with the moving imaging member to form a process nip. The method further includes introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

The liquid toner image development systems of the prior art that apply a substantially uniform layer of liquid toner to an imaging member do not contemplate developing an image directly onto a substrate at the same station where the image is separated from the imaging member. Rather, these prior art development systems develop and transfer the image from the imaging member to an image separator at a first station and subsequently transfer the image from the image separator to a substrate at a different station.

SUMMARY OF THE INVENTION

There is the need for a liquid image development system that separates and develops an image from an imaging member to a substrate at a single station.

There is also the need for a more simply constructed and more economical printer that is capable of producing a high quality output product.

This invention provides an image development apparatus and method including an imaging member having a surface supplied with toner particles forming an image portion and a non-image portion and an image separator in contact with the imaging member. The image separator and imaging member receive and guide a substrate inserted between them. The image separator selectively separates an image portion of the toner particles on the imaging member from a non-image portion of the toner particles on the imaging member and develops the image portion on the substrate.

In accordance with one aspect of the present invention, the image separator is a biased roll member having an opposite polarity to that of the image portion of the toner particles so as to attract the image portion of the toner particles toward the roll member and onto the substrate.

The invention further provides that a charging device forms an image-wise ion stream extending from the charging device to the toner particles on the imaging member. The ion stream generates a secondary electrostatic latent image in the toner particles having image and non-image portions in a configuration corresponding to a latent image formed beneath the toner particles, but having opposite charges to those of the image and non-image areas of the latent image.

In accordance with one embodiment of the present invention, the charging device includes a wide beam charging source that introduces free mobile ions in the vicinity of the toner particles on the imaging member. In a preferred embodiment, the charging device includes a scorotron with a grid. The scorotron is provided with an energizing bias at the grid. The bias is between the charge potentials associated with the image portion and the non-image portion of the toner particles so as to charge the toner particles in an image-wise manner.

In accordance with a second embodiment of the present invention, free mobile ions are introduced in the vicinity of the toner particles on the imaging member by inducing air breakdown in the vicinity of the toner particles. In a preferred embodiment, the air breakdown charging device includes a roll member adjacent the toner particles on the imaging member. An electrical biasing source is coupled to the roll member and provides a voltage potential to the roll member causing an electrical discharge as the voltage is increased to the point of air breakdown. The electrical discharge is induced only in a limited region such that a discharge current will flow across a gap between the roll member and the toner particles.

In accordance with a third embodiment of the present invention, the image separator introduces free mobile ions in the vicinity of the toner particles on the imaging member by inducing air breakdown in the vicinity of the toner particles. Thus, the image separator functions as an air breakdown charging device, as well as attracting the image portion of the toner particles toward the roll member and onto the substrate. The electrical biasing source coupled to the roll member of the image separator provides a voltage potential to the roll member causing an electrical discharge as the voltage is increased to the point of air breakdown. The electrical discharge is induced only in a limited region such that a discharge current will flow across a pre-nip gap between the roll member and the toner particles.

These and other features and advantages of this invention are described in or apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

Figure 1:
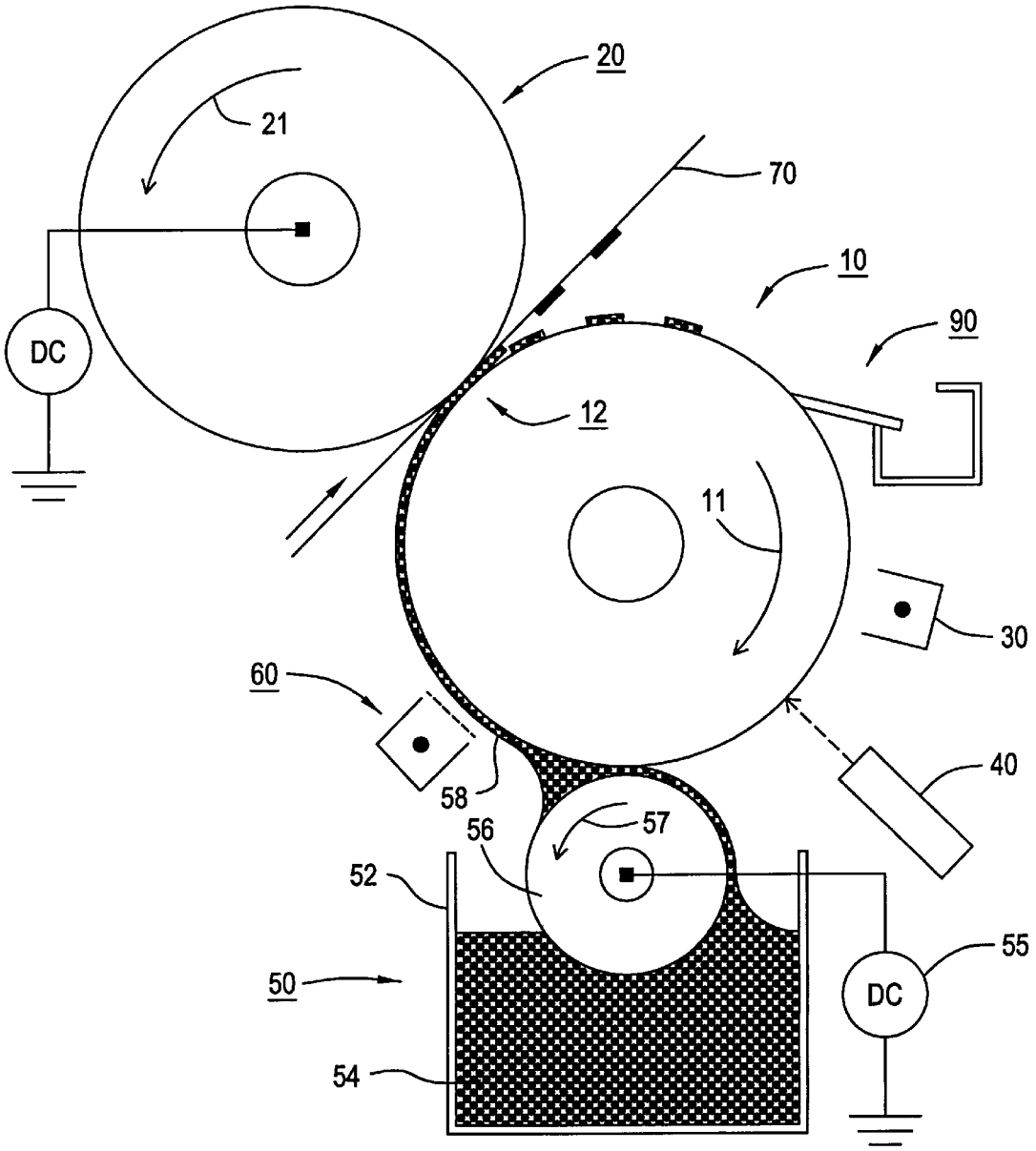
FIG. 1 is a schematic illustration of a direct to final substrate image development system according to the invention.

For a general understanding of the features of the present invention, reference is made to the drawings, wherein like reference numerals have been used throughout to identify identical or similar elements. Initially, a system and process for accomplishing direct to final substrate printing in accordance with the present invention will be described with reference to FIG. 1. While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention.

FIG. 1 shows one embodiment of a direct to final substrate image development system according to this invention. As shown in FIG. 1, an imaging apparatus includes an imaging member 10 situated in contact with an image separating member 20, thereby forming a development nip 12 therebetween. The imaging member 10 includes an imaging surface of any type capable of having an electrostatic latent image formed thereon. An exemplary imaging member 10 may include a typical photoconductor or other photoreceptive component of the type known to those of skill in the art in electrophotography, wherein a surface layer having photoconductive properties is supported on a conductive support substrate. Although the following description will describe by example a system and process in accordance with the present invention incorporating a photoconductive imaging member, it will be understood that the present invention contemplates the use of various alternative embodiments for imaging member 10 as are well known in the art of electrostatographic printing, including, for example, but not limited to, non-photosensitive imaging members such as a dielectric charge retaining member of the type used in ionographic printing machines, or electroded substructures capable of generating charged latent images.

Imaging member 10 is rotated, as indicated by arrow 11, so as to transport the surface thereof in a process direction for implementing a series of image forming steps in a manner similar to typical electrostatographic printing processes. Initially, in the exemplary embodiment of FIG. 1, the photoconductive surface of imaging member 10 passes through a charging station, which may include a corona generating device 30 or any other charging apparatus for applying an electrostatic charge to the surface of the imaging member 10. The corona generating device 30 is provided for charging the photoconductive surface of imaging member 10 to a relatively high, substantially uniform potential. It will be understood that various charging devices, such as charge rollers, charge brushes and the like, as well as induction and semi-conductive charge devices, among other devices which are well known in the art, may be incorporated into the charging station for applying a charge potential to the surface of the imaging member 10.

After the imaging member 10 is brought to a substantially uniform charge potential, the charged surface thereof is advanced to an image exposure station, identified generally by reference numeral 40. The image exposure station projects a light image corresponding to the input image onto the charged photoconductive surface. In the case of an imaging system having a photosensitive imaging member, as currently described, the light image projected onto the surface of the imaging member 10 selectively dissipates the charge thereon for recording an electrostatic latent image on the photoconductive surface. The electrostatic latent image comprises image areas defined by a first charge voltage and non-image areas defined by a second charge voltage in image configuration corresponding to the input image informational areas. The image exposure station 40 may incorporate various optical image formation and projection components as are known in the art, and may include various well known light lens apparatus or digital scanning systems for forming and projecting an image from an original input document onto the imaging member 10. Alternatively, various other electronic devices known in the art may be utilized for generating an electronic information signal for creating the electrostatic latent image on the imaging member. It will be understood that the electrostatic latent image may be comprised of image and non-image areas that are defined areas having opposite charge polarities or by areas that merely have first and second distinguishable charge potential levels.

As shown in FIG. 1, a layer of charged or uncharged toner particles is deposited on the entire surface of the latent image bearing imaging member 10. A toner supply apparatus or applicator 50 transports a layer of charged or uncharged toner particles (and possibly some carrier mechanism such as a liquid solvent) is transported onto the surface of the imaging member 10. FIG. 1 shows an illustrative toner applicator 50, wherein a housing 52 is adapted to accommodate a supply of toner particles 54 and any additional carrier material, if necessary. The toner applicator 50 includes an applicator roller 56 which is rotated in a direction as indicated by arrow 57 to transport toner from the housing 52 into contact with the surface of the imaging member 10, thereby forming a substantially uniformly distributed toner layer, or a "toner cake", 58 thereon. The applicator roller 56 is coupled to an electrical biasing source 55 for implementing a so-called forward biasing scheme, wherein the toner applicator 56 is provided with an electrical bias of magnitude greater than both the image and non-image (background) areas of the electrostatic latent image on the imaging member 10, thereby creating electrical fields extending from the toner applicator roll 56 to the surface of the imaging member 10. These electrical fields cause toner particles to be transported to the imaging member 10 for forming a substantially uniform layer of toner particles on the surface thereof.

In accordance with the present invention, after the toner layer 58 is formed on the surface of the electrostatic latent image bearing imaging member 10, the toner layer is charged in an image-wise manner. In the case of a charged toner layer 58, as is the case in the system of FIG. 1, a charging device 60, represented schematically in FIG. 1 as a well-known scorotron device, is provided for introducing free mobile ions in the vicinity of the charged latent image to facilitate the formation of an image-wise ion stream extending from the charging device 60 to the latent image on the surface of the imaging member 10. The image-wise ion stream generates a secondary latent image in the toner layer made up of oppositely charged toner particles in an image configuration corresponding to the latent image formed on the imaging member 10.

The process of generating the secondary latent image in the toner cake layer is described below in greater detail with respect to FIG. 2, where the initially charged toner cake 58 is illustrated, for purposes of simplicity only, as a uniformly distributed layer of negatively charged toner particles having the thickness of a single toner particle. The toner cake resides on the surface of the imaging member 10 which is shown as being transported from left to right past the broad source ion charging device 60. The broad source ion charging device 60 provides free mobile ions in the vicinity of the imaging member 10 having the toner layer 58 and latent image thereon. As such, the broad source ion device may be embodied as various known devices, including, but not limited to, any of the various known corona generating devices available in the art, as well as charging roll type devices, solid state charge devices and electron or ion sources analogous to the type commonly associated with ionographic writing processes.

After the secondary latent image is formed in the toner layer, the latent image bearing toner layer is advanced to the image separator 20. A final substrate 70, such as paper or the like, is fed through the development nip 12 in the same direction as the directions of rotation 11, 21 of the imaging member 10 and image separating member 20, respectively. As shown in FIG. 1, the image separator 20 is provided in the form of a second biased roll member having a surface adjacent to the surface of the imaging member 10 and preferably contacting the toner layer 58 residing on the imaging member 10. An electrical biasing source is coupled to the image separator 20 to bias the image separator 20 so as to attract image areas of the latent image formed in the toner layer 58 for simultaneously separating the image and non-image portions of the toner layer 58 and producing a developed image directly on a final substrate 70, such as paper or the like. As shown in FIG. 1, the image separator 20 is biased with a polarity opposite the charge polarity of the image areas in the toner layer 58 for attracting image areas therefrom. Thus, the image separator 20 develops the image portions of the toner layer 58 directly on the surface of the final substrate 70, while leaving background image byproduct on the surface of the imaging member 10.

In a final step of the printing process, the background image byproduct on the imaging member 10 is removed from the surface of the imaging member 10 in order to clean the surface in preparation for a subsequent imaging cycle. FIG. 1 illustrates a simple blade cleaning apparatus 90 for scraping the imaging member surface as is well known in the art. Alternative embodiments may include a brush or roller member for removing toner from the surface on which it resides. In a preferred embodiment, the removed toner associated with the background image is transported to a toner sump or other reclaim vessel so that the waste toner can be recycled and used again to produce the toner cake in subsequent imaging cycles once again, it is noted that several concepts for cleaning and toner reclaim which could be beneficially used in combination with the image-wise charging system of the present invention have been disclosed in the relevant patent literature.

Figure 2:
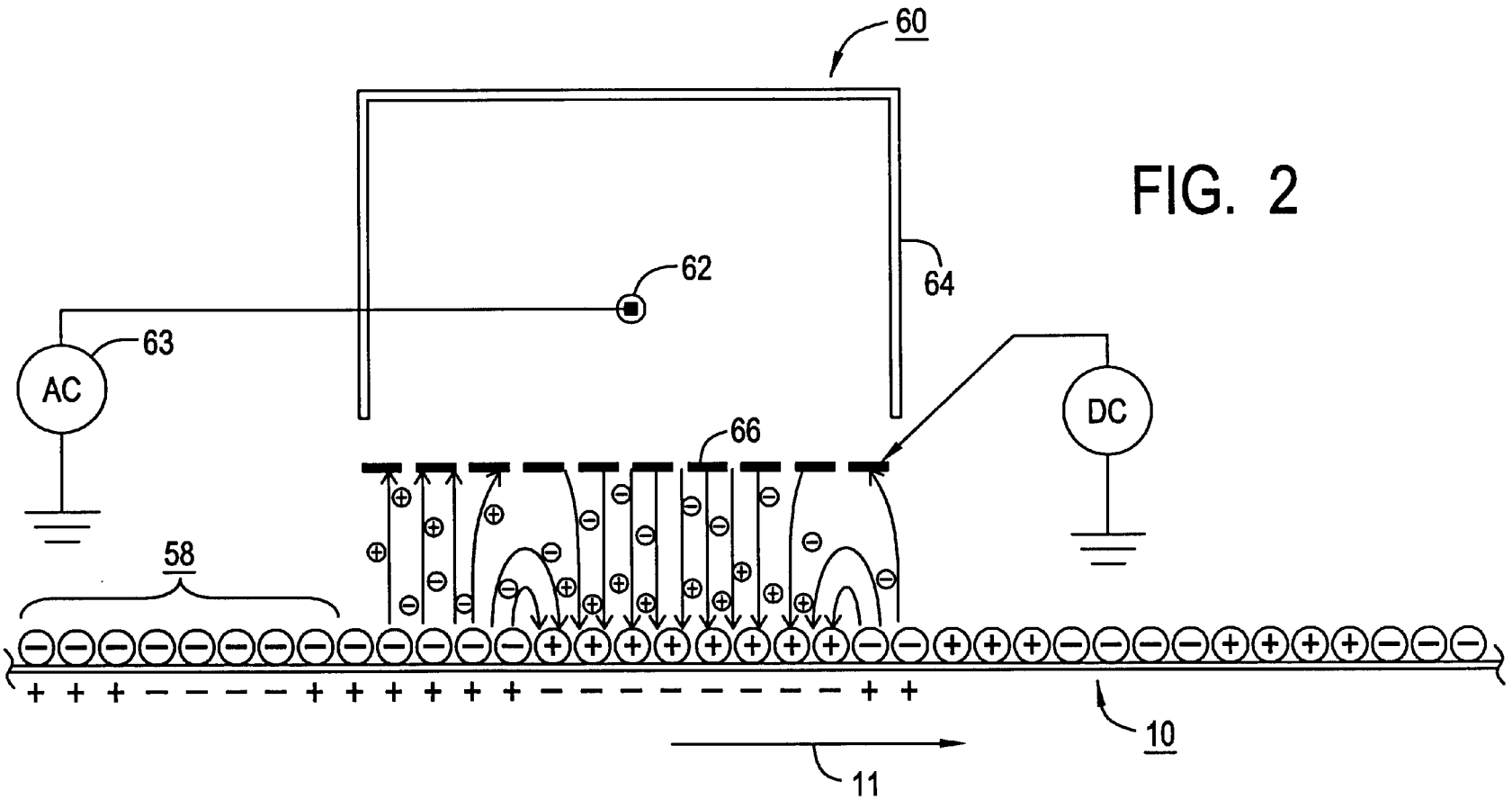
FIG. 2 is an exploded view illustrating image-wise reverse charging of a toner layer by a broad source ion charging device in the direct to final substrate image development system of FIG. 1.

In the embodiment shown in FIG. 2, a scorotron type corona generating device is utilized. The scorotron device comprises a corona generating electrode 62 enclosed within a shield member 64 surrounding the electrode 62 on three sides. A wire grid 66 covers the open side of the shield member 64 facing the imaging member 10. In operation, the corona generating electrode 62, otherwise known as a coronode, is coupled to an electrical biasing source 63 capable of providing a relatively high voltage potential to the coronode, which causes electrostatic fields to develop between the coronode 62 and the grid and the imaging member 10. The force of these fields causes the air immediately surrounding the coronode to become ionized, generating free mobile ions which are repelled from the coronode toward the grid 66 and the imaging member 10. As is well known to one of skill in the art, the scorotron grid 66 is biased so as to be operative to control the amount of charge and the charge uniformity applied to the surface of the imaging member 10 by controlling the flow of ions through the electrical field formed between the grid 66 and the surface of the imaging member 10.

With respect to the process illustrated by FIG. 2, it will be seen that the function of the charging device 60 is to charge the toner layer in an image-wise manner. As shown in FIG. 2, this process will be described with respect to a negatively charged toner layer. It should be appreciated that the process can also be implemented using a positively charged toner layer or an uncharged, or neutral, toner layer, as is described in greater detail in the incorporated application Ser. No. '236.

In the case of a charged toner layer, the process of the present invention requires that the ion source 60 provide ions having a charge opposite the toner layer charge polarity. Thus, in the case of the negatively charged toner layer 58 shown in FIG. 2, the scorotron 60 is preferably provided with an energizing bias at grid 66 between the potential of the image and non-image areas of the latent image on the imaging member 10. Under certain circumstances, such as when the charge on the toner layer is sufficient to prevent charge reversal due to injected wrong sign charge, the energizing bias at the grid 66 can be higher or lower than the bias of the image and non-image areas of the latent image. In addition, the energizing bias applied to the grid 66 can be provided in the form of either a direct current (DC) electrical bias or an alternating current (AC) bias having a DC offset. Operatively, in areas where the latent image is at a potential lower than the bias potential of the charging source grid 66, the bias potential generates electrostatic field lines in a direction toward the imaging member 10 and toner layer 58 thereon. Conversely, electrostatic field lines are generated in a direction away from the imaging member 10 and toner layer 58 thereon in areas where the latent image is at a potential higher than the bias potential of the charging source grid 66.

FIG. 2 illustrates the effect of the field lines in the case of an ion source energized by an AC voltage having a DC grid bias between the charge potential associated with image and non-image areas of the latent image, represented by (+) and (−) signs, respectively, on the back side of the imaging member 10. As illustrated, positive ions flow from the ion source 60, in the direction of the field lines, while negative ions (electrons) flow in a direction opposite to the direction of the field lines. The positive ions generated in the vicinity of a positively charged area of the latent image are repelled from the toner layer 58, although the positive ions in the vicinity of a negatively charged area of the latent image are attracted to the toner layer 58, and captured thereby. Conversely, negative ions generated in the vicinity of a positively charged area of the latent image are attracted to the imaging member 10 and absorbed into the negatively charged toner 58, thereby enhancing toner charge in that area, although the negative ions in the vicinity of a negatively charged areas of the latent image are repelled by the toner layer. The free flowing ions generated by the ion source 60 are captured by the toner layer 58 in a manner corresponding to the latent image on the imaging member, causing image-wise charging of the toner layer 58 and creating a secondary latent image within the toner layer 58 that is charged opposite in charge polarity to the charge of the original latent image. Under optimum conditions, the charge associated with the original latent image will be captured and converted into the secondary latent image in the toner layer 58 such that the original electrostatic latent image becomes substantially or completely dissipated into the toner layer 58.

Figure 3:
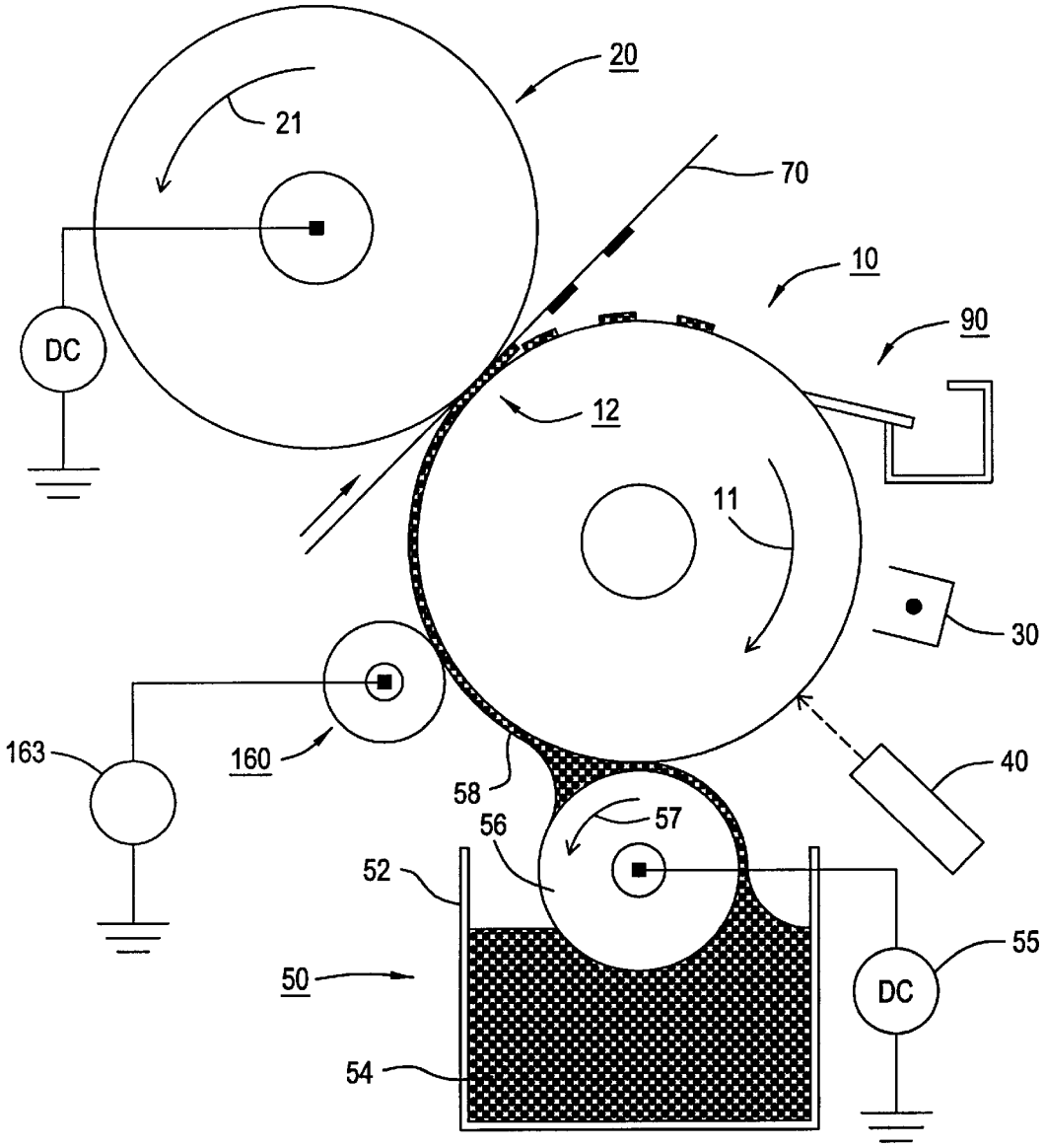
FIG. 3 is a schematic illustration of a direct to final substrate image development system according to a second embodiment of the invention.

FIG. 3 shows an alternative embodiment of the direct to final substrate printing system of this invention. In particular, FIG. 3 illustrates a direct to final substrate printing system with air breakdown charging and development. The system shown in FIG. 3 is substantively similar to that shown in FIG. 1, with the exception that the charging device 160 is formed as a biased roll member, rather than a broad source ion charging device as described above. Similar to the broad source ion charging device 60 of FIG. 2, the toner layer is charged in an image-wise manner by inducing ionization of the air in the vicinity of the toner layer on the electrostatic latent image bearing imaging member 10. In FIG. 3, the biased roll member 160, situated adjacent the toner layer on the imaging member 10, introduces free mobile ions in the vicinity of the charged latent image to facilitate the formation of an image-wise ion stream extending from the biased roll member 160 to the latent image on the surface of the imaging member 10. The image-wise ion stream generates a secondary latent image in the toner layer made up of oppositely charged toner particles in an image configuration corresponding to the latent image formed on the imaging member 10.

Figure 4:
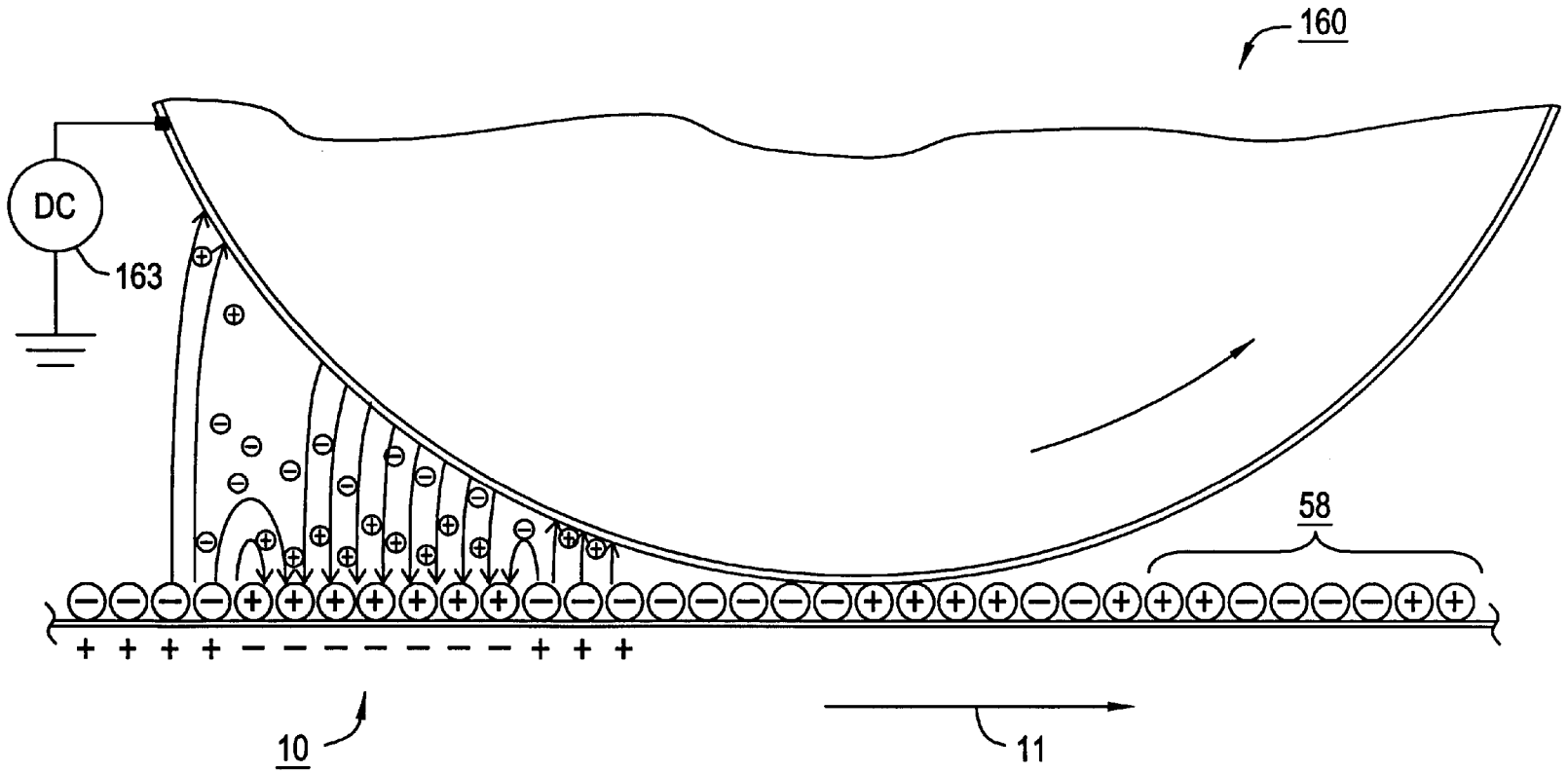
FIG. 4 is an exploded view illustrating image-wise reverse charging of a toner layer via air breakdown in the direct to final substrate image development system of FIG. 3.

The process of generating the secondary latent image in the toner cake layer via air breakdown is described in greater detail with respect to FIG. 4, where an initially charged toner cake 58 is illustrated, for purposes of simplicity only, as a uniformly distributed layer of negatively charged toner particles having the thickness of a single toner particle. The toner cake resides on the surface of the imaging member 10 which is shown as being transported from left to right past the biased roll member 160. The primary function of the biased roll member 160 is to provide free mobile ions in the vicinity of the imaging member 10 having the toner layer 58 and latent image thereon. As previously noted, it is known that when two conductors are held near each other with a voltage applied between the two, electrical discharge will occur as the voltage is increased to the point of air breakdown. Thus, at a critical point, a discharge current is created in the air gap between the conductors. This point is commonly known as the Paschen threshold voltage. When the conductors are very close together (a few thousandths of an inch) discharge can take place without sparking, such that a discharge current will be caused to flow across a gap between the roll member 160 and the toner layer 58. The embodiment of FIG. 4 exploits this phenomenon to induce image-wise charging.

As shown in FIGS. 3 and 4, the biased roll member 160 is coupled to an electrical biasing source 163 capable of providing an appropriate voltage potential to the roll member, sufficient to produce air breakdown in the vicinity of a latent image bearing imaging member. Preferably, the voltage applied to the roll 160 is maintained at a predetermined potential such that electrical discharge is induced only in a limited region where the surface of the roll member 160 and the imaging member 10 are in very close proximity and the voltage differential between the roll and the image and/or non-image areas of the latent image exceeds the Paschen threshold voltage.

Similar to the embodiment shown in FIG. 2, the process described with respect to FIG. 4 includes a negatively charged toner layer. Again, it should be appreciated that the process can also be implemented using a positively charged toner layer or an uncharged, or neutral, toner layer, as is described in greater detail in the incorporated application Ser. No. '236.

In the case of a charged toner layer, the process of the present invention requires that, at a minimum, the air breakdown process provide ions having a charge opposite the toner layer charge polarity. In the case of a negatively charged toner layer 58, as shown in FIG. 4, the biased roll member 160 is provided with an energizing bias between the potential of the image and non-image areas of the latent image on the imaging member 10, yet exceeding the Paschen threshold voltage, so that positive ions will be generated and caused to flow in the direction of low potential areas of the latent image. Under certain circumstances, such as when the charge on the toner layer is sufficient to prevent charge reversal due to injected wrong sign charge, the energizing bias can be higher or lower than the bias of the image and non-image areas of the latent image. In addition, the energizing bias can be provided in the form of either a direct current (DC) electrical bias or an alternating current (AC) bias with or without a DC offset.

FIG. 4 illustrates the effect of the field lines in the case of a roll member energized by a DC voltage between the charge potential associated with image and non image areas of the latent image, represented by (+) and (−) signs, respectively, on the back side of the imaging member 10. As illustrated, positive ions flow from the roll member 160, in the direction of the field lines, while negative ions (electrons) flow in a direction opposite to the direction of the field lines. The positive ions generated in the vicinity of a positively charged area (relative to the roll member bias potential) of the latent image are repelled from the toner layer 58, although the positive ions in the vicinity of a negatively charged area (relative to the roll member bias potential) of the latent image are attracted to the toner layer 58, and captured thereby. Conversely, negative ions generated in the vicinity of a positively charged area (relative to the roll member bias potential) of the latent image are attracted to the imaging member 10 and absorbed into the negatively charged toner 58, thereby enhancing toner charge in that area, although the negative ions in the vicinity of a negatively charged areas (relative to the roll member bias potential) of the latent image are repelled by the toner layer.

The free flowing ions generated by the air breakdown induced ionization in the pre-nip region are captured by the toner layer 58 in a manner corresponding to the latent image on the imaging member, causing image-wise charging of the toner layer 58, and creating a secondary latent image within the toner layer 58 that is charged opposite in charge polarity to the charge of the original latent image. Under optimum conditions, the charge associated with the original latent image will be converted into the secondary latent image in the toner layer 58 and/or absorbed by the charging roll 160 such that the voltage differential which defines image and non-image areas in the original electrostatic latent image becomes substantially or completely dissipated.

In the above-described processes, a charged toner layer 58 is situated on a latent image bearing imaging member 10, wherein the charged toner layer 58 is exposed to charged ions for selectively reversing the preexisting charge of the toner layer. Since the toner layer is initially charged, fringe fields, illustrated as field lines extending between image and non-image areas on the latent image can influence the charged toner cake. While the existence of these fringe fields may be advantageous if the fringe fields can be properly controlled, these fringe fields may manifest themselves as image quality defects in the final output document. The fringe fields can be prevented, or at least minimized, by maintaining good contact between the imaging member 10 and the image separating member 20 at the development nip 12 formed therebetween.

In addition, as disclosed in the incorporated application Ser. No. '292, the fringe field effect of the image-wise toner charging process described with respect to FIGS. 1 and 2 may be substantially eliminated by carrying out the process using a neutrally charged toner cake layer coated on the imaging member. In this alternate embodiment, an ion source, or multiple ion sources, must be provided for presenting both negative and positive polarity ions to the toner layer in the vicinity of the latent image for oppositely charging regions of the toner layer corresponding to image and non-image areas of the latent image.

Furthermore, as disclosed in the incorporated application Ser. No. '236, the fringe field effect of the image-wise toner charging process described with respect to FIGS. 3 and 4 may be substantially eliminated by carrying out the process using a neutrally charged toner cake layer coated on the imaging member. In this alternate embodiment, the roll member 160, or multiple roll members, must be provided for presenting both negative and positive polarity ions to the toner layer in the vicinity of the latent image for oppositely charging regions of the toner layer corresponding to image and non-image areas of the latent image.

Figure 5:
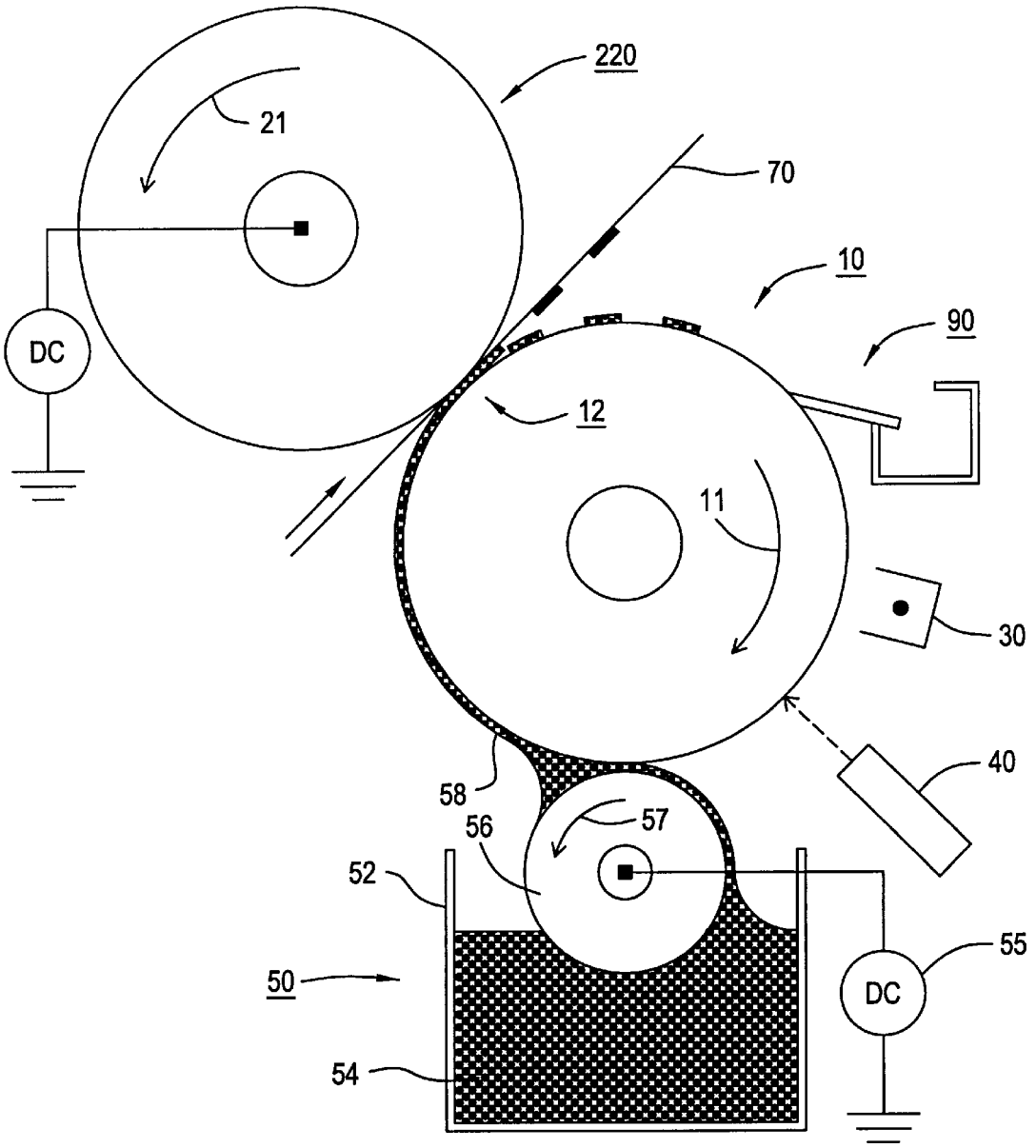
FIG. 5 is a schematic illustration of a direct to final substrate image development system according to a third embodiment of the invention.
Figure 6:
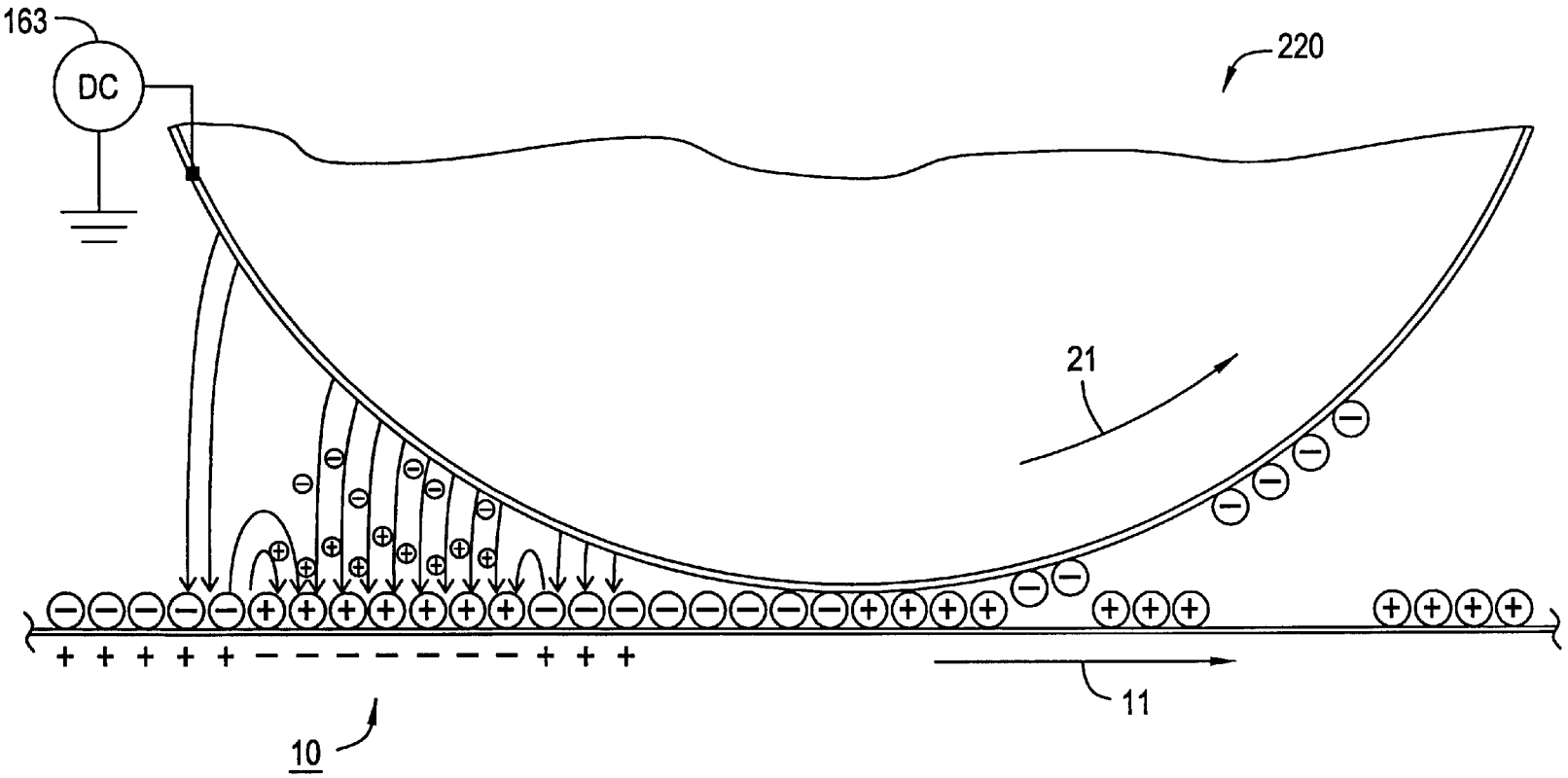
FIG. 6 is an exploded view illustrating image-wise reverse charging of a toner layer via air breakdown in the direct to final substrate image development system of FIG. 5.

FIGS. 5 and 6 show another alternative embodiment of the direct to final substrate printing system of this invention. In particular, FIG. 5 illustrates a direct to final substrate printing system performing air breakdown charging and development at a single station. The system shown in FIG. 5 is substantially similar to that shown in FIG. 3, with the exception that the image separator 220 is formed as a biased roll member for accomplishing air breakdown charging, and separates the image portion of the toner particles from the imaging member 10. Similar to the air breakdown charging device 160 of FIGS. 3 and 4, the toner layer is charged in an image-wise manner by inducing ionization of the air in the vicinity of the toner layer on the electrostatic latent image bearing imaging member 10. In FIG. 5, the biased image separator 220, situated in contact with the toner layer on the imaging member 10, introduces free mobile ions in the vicinity of the charged latent image to facilitate the formation of an image-wise ion stream extending from the biased image separator 220 to the latent image on the surface of the imaging member 10. The image-wise ion stream generates a secondary latent image in the toner layer made up of oppositely charged toner particles in an image configuration corresponding to the latent image formed on the imaging member 10.

The process of generating the secondary latent image in the toner cake layer via air breakdown and separating the image portion of the toner layer from the imaging member 10 is described in greater detail with respect to FIG. 6. FIG. 6 shows an initially charged toner cake 58, for purposes of simplicity only, as a uniformly distributed layer of negatively charged toner particles having the thickness of a single toner particle. The toner cake resides on the surface of the imaging member 10, which is shown as being transported from left to right past the biased image separator 220. One function of the biased image separator 220 is to provide free mobile ions in the vicinity of the imaging member 10 having the toner layer 58 and latent image thereon. A second function of the biased image separator 220 is to separate the image portion of the toner layer from the imaging member 10 and develop the image portion directly onto a substrate 70.

In an exemplary embodiment illustrating the operation of the present invention in accordance with the embodiment of FIGS. 5 and 6, an imaging member 10 is initially charged to −500 volts and thereafter selectively discharged to 0 volts for producing an electrostatic latent image thereon. Toner particles charged to −500 volts, immersed in a liquid carrier medium, are applied to the surface of the imaging member 10 to form a negatively charged toner layer thereon. The Paschen threshold voltage in this example is 600 volts. The image separator 220 is biased to +500 volts, thus producing a voltage potential of 1000 volts across the development nip.

As a result of the voltage potential exceeding the Paschen threshold voltage, air breakdown is caused at the entrance to the development nip, but only in the non-image areas of the imaging member where the original charge potential of −500 volts remains on the imaging member 10. Thus, positive ions are attracted from the image separator 220 to the imaging member 10 and captured in the toner layer to change the non-image portion of the toner layer to a positively charged area. Meanwhile, the negative ions are attracted from the imaging member toward the image separator 220.

In the post-nip region the +500 volts applied to the image separator 220 operates to attract the negatively charged image portions of the toner layer to develop the image associated with the toner layer by selectively separating the image portion of the toner layer from the imaging member 10. Since the latent image on the imaging member dissipates as a function of the air breakdown process, no air breakdown occurs in the post-nip region where image separation occurs. The foregoing process has been demonstrated to produce very high resolution images with substantially undeveloped background image development.

It should be appreciated that various systems directed toward the transportation of liquid developing material having toner particles immersed in a carrier liquid, can be incorporated into the present invention. Examples of such liquid transport systems can include a fountain-type device as disclosed generally in commonly assigned U.S. Pat. No. 5,519,473, or any other system capable of causing a flow of liquid developing material, including toner particles immersed in a liquid carrier medium, onto the surface of the imaging member. It is noted that, in the case of liquid developing materials, it is desirable that the toner cake formed on the surface of the imaging member 10 should be comprised of at least approximately 10% by weight toner solids, and preferably in the range of 15%–35% by weight-toner solids.

Further, it should be appreciated that numerous other devices or apparatus may be utilized for depositing the toner layer 58 on the surface of the imaging member 10, including various well known apparatus analogous to development devices used in conventional electrostatographic applications, such as, but not limited, to powder cloud systems which transport developing material to the imaging member by means of a gaseous medium such as air, brush systems which transport developing material to the imaging member by means of a brush or similar member, and cascade systems which transport developing material to the imaging member by means of a system for pouring or cascading the toner particles onto the surface of the imaging member.

With respect to the foregoing toner cake formation process and various apparatus therefor, it should also be appreciated that that the presence of the latent image on the imaging member may generate some fringe fields in areas of interface between image and non-image areas of the latent image. However, these fringe fields are minimal relative to the fields associated with conventional electrostatic although some toner layer non-uniformity may result, the toner layer 58 deposited on the imaging member 10 surface can be characterized as having a substantially uniform density per mass area in both image and background areas of the latent image. In fact, it is not a requirement of the invention that the toner layer be uniform or even substantially uniformly distributed on the surface of the imaging member 10, so long as the toner layer covers, at a minimum, the desired image areas of the latent image.

With respect to the process illustrated by FIGS. 2 and 4, the function of the charging device 60, 160 and 220 is to charge the toner layer 58 in an image-wise manner. The toner cake 58 described above can be created in various ways. For example, depending on the materials utilized in the printing process, as well as other process parameters such as process speed and the like, a layer of toner particles having sufficient thickness, preferably on the order of between 2 and 15 microns and more preferably between 3 and 8 microns, may be formed on the surface of the imaging member 10 by merely providing adequate proximity and/or contact pressure between the applicator roller 56 and the imaging member 10. Alternatively, electrical biasing may be employed to assist in actively moving the toner particles onto the surface of the imaging member 10.

It should also be appreciated that a pressure transfer system may be employed which may include a heating and/or chemical application device for assisting in the pressure transfer and fixing of the developed image on the output copy substrate 70. Further, it should be appreciated that separate transfer and fusing systems may be provided, wherein the fusing or so-called fixing system may operate using heat (by any means such as radiation, convection, conduction, induction, etc.), or other known fixation process which may include the introduction of a chemical fixing agent. The use of a fusing system in addition to the direct to final substrate transfer would be critical if this invention is to be applied to image-on-image development, such as, for example, those used in color printing systems. Since the art of electrostatographic printing is well known, it is noted that several concepts for transfer and/or fusing which could be beneficially used in combination with the image-wise charging system of the present invention have been disclosed in the relevant patent literature.

Furthermore, it should be appreciated that the developed image may be transferred to the final substrate 70 by other means known in the art such as, for example, an electrostatic transfer apparatus including a corona generating device of the type previously described. If a corona generating device is used as the transfer apparatus, the corona generating device must be positioned adjacent an extended nip formed between the imaging member 10 and at least a pair of rollers (not shown).

The invention has been described with particularity in connection with the embodiments. However, it should be appreciated that many alternatives, modifications and variations may be made to the embodiments of the invention without departing from the spirit and inventive concepts contained herein. Accordingly, the present invention is intended to embrace all such alternatives, modifications and variations.

What is claimed is:

1. An image development system, comprising:

an imaging member having a surface supplied with toner particles forming an image portion and a non-image portion; and an image separator that contacts the imaging member through a substrate received between the image separator and the imaging member, the image separator and the imaging member transporting and guiding the substrate, the image separator selectively separating the image portion of the toner particles on the imaging member from the non-image portion of the toner particles on the imaging member and developing the image portion on the substrate.

2. The image development system of claim 1, wherein the image separator comprises a roll member, and the image development system further comprises an electrical biasing source coupled to the roll member.

3. The image development system of claim 1, wherein the image portion of the toner particles on the imaging member has a first polarity and the image separator is biased with a charge having a second polarity, the second polarity being opposite the first polarity, wherein the image separator removes the image portion of the toner particles from the imaging member and develops the image portion on the substrate by attraction between the first polarity and the second polarity.

4. The image development system of claim 1, further comprising:

an image exposure station that projects a latent image onto the imaging member;

a toner applicator that applies the toner particles to the imaging member; and a charging device that selectively changes a charge of the toner particles applied on the imaging member.

5. The image development system of claim 4, wherein the charging device forms an image-wise ion stream extending from the charging device to the toner particles on the imaging member.

6. The image development system of claim 5, wherein the image-wise ion stream generates a secondary latent image in the toner particles in accordance with the latent image formed by the image exposure station beneath the toner particles.

7. The image development system of claim 5, wherein the charging device comprises a broad source ion charging device that provides free mobile ions in the vicinity of the imaging member.

8. The image development system of claim 7, wherein the broad source ion charging device comprises a scorotron having a grid, the grid being provided with an energizing bias at a level between charge potentials associated with the image portion and with the non-image portion to charge the toner particles in an image-wise manner.

9. The image development system of claim 5, wherein the charging device comprises an air breakdown charging device that provides free mobile ions in the vicinity of the imaging member.

10. The image development system of claim 9, wherein the air breakdown charging device comprises an air breakdown roll member adjacent the toner particles on the imaging member and an electrical biasing source coupled to the air breakdown roll member, wherein the electrical biasing source provides a voltage to the roll member causing an electrical discharge as a voltage potential between the roll member and the imaging member is increased to an air breakdown voltage, and wherein the electrical discharge is induced only in a limited region such that a discharge current is caused to flow across a gap between the air breakdown roll member and the toner particles to charge the toner particles in an image-wise manner.

11. The image development system of claim 1, wherein the image separator is a charging device that selectively changes a charge of the toner particles applied on the imaging member.

12. The image development system of claim 1, wherein the image separator forms an image-wise ion stream extending from the image separator to the toner particles on the imaging member.

13. The image development system of claim 1, wherein the image separator is an air breakdown charging device that provides free mobile ions in the vicinity of the imaging member.

14. The image development system of claim 13, wherein the image separator comprises an air breakdown roll member in contact with the toner particles on the imaging member and an electrical biasing source coupled to the air breakdown roll member, wherein the electrical biasing source provides a voltage to the roll member causing an electrical discharge as a voltage potential between the image separator and the imaging member is increased to an air breakdown voltage, and wherein the electrical discharge is induced only in a limited region such that a discharge current is caused to flow across a gap between the air breakdown roll member and the toner particles to charge the toner particles in an image-wise manner.

15. A method of developing an image on a substrate in a toner-based image development system, comprising:

supplying toner particles to image areas and non-image areas of an imaging member;

transporting and guiding the substrate between the imaging member and an image separator, the imaging member and the image separator each being in driving contact with opposite sides of the substrate;

separating an image portion of the toner particles on the imaging member from the imaging member; and developing the image portion of the toner particles on the substrate.

16. The method of claim 15, wherein separating an image portion comprises electrically biasing the image separator with a charge having a predetermined polarity.

17. The method of claim 16, wherein the predetermined polarity is a first polarity, and wherein separating an image portion further comprises generating a charge in the image portion of the toner particles on the imaging member having a second polarity, the second polarity being opposite the first polarity, removing the image portion of the toner particles from the imaging member and developing the image portion on the substrate by attraction between the first polarity and the second polarity.

18. The method of claim 15, further comprising:

projecting a latent image onto the imaging member to generate the image areas and the non-image areas on the imaging member;

applying the toner particles to the imaging member; and selectively changing an electrostatic charge of the toner particles on the imaging member.

19. The method of claim 18, wherein selectively changing an electrostatic charge further includes generating a secondary latent image in the toner particles in accordance with the latent image formed on the imaging member beneath the toner particles.

20. The method of claim 18, wherein the image development system includes an air breakdown roll member adjacent the toner particles on the imaging member, and wherein selectively changing an electrostatic charge further includes providing an electrical bias to the roll member to create a voltage potential causing an electrical discharge in a limited region as the voltage potential is increased to an air breakdown voltage, such that a discharge current is caused to flow across a gap between the roll member and the toner particles to charge the toner particles in an image-wise manner.

21. The method of claim 18, wherein the image development system includes a scorotron having a grid, and wherein selectively changing an electrostatic charge further includes providing an energizing bias to the grid at a level between charge potentials associated with the image portion and a non-image portion of the toner particles so as to charge the toner particles in an image-wise manner.

22. The method of claim 18, wherein selectively changing an electrostatic charge includes forming an image-wise ion stream extending from a charging device to the toner particles on the imaging member.

23. The method of claim 22, wherein forming an image-wise ion stream includes providing free mobile ions in the vicinity of the imaging member.

24. The method of claim 18, wherein selectively changing an electrostatic charge includes forming an image-wise ion stream extending from the image separator to the toner particles on the imaging member.

25. The method of claim 24, wherein forming an image-wise ion stream includes providing free mobile ions in the vicinity of the imaging member.

26. The method of claim 24, wherein the image separator includes an air breakdown roll member in contact with the toner particles on the imaging member, and wherein selectively changing an electrostatic charge further includes providing an electrical bias to the image separator to create a voltage potential causing an electrical discharge in a limited region as the voltage potential is increased to an air breakdown voltage, such that a discharge current is caused to flow across a gap between the image separator and the toner particles to charge the toner particles in an image-wise manner.

* * * * *